United States Patent [19]

Levin et al.

[11] Patent Number: 4,871,175

[45] Date of Patent: Oct. 3, 1989

[54] ALIGNMENT TRAINING DEVICE FOR GOLFERS

[76] Inventors: Steven D. Levin, 1371 Abbey Way; William A. Swenson, 1384 Abbey Way, both of Bensalem, Pa. 19020

[21] Appl. No.: 220,961

[22] Filed: Jul. 14, 1988

[51] Int. Cl.[4] ..... A63B 69/36

[52] U.S. Cl. ..... 273/187 R; 273/DIG. 1

[58] Field of Search ..... 33/459, 468, 460, 461, 33/462, 463; 273/187 R, 187 A, 187 B, 183 A

[56] References Cited

U.S. PATENT DOCUMENTS

| | | | |
|---|---|---|---|
| 770,770 | 9/1904 | Morrison | 33/459 |
| 1,484,064 | 2/1924 | Erickson et al. | 273/187 |
| 1,484,390 | 2/1924 | Gibbs et al. | 273/187 |
| 1,761,532 | 6/1930 | Morris | 273/183 A |
| 2,941,808 | 6/1960 | Smith | 273/187 |
| 3,166,327 | 1/1965 | Champion | 273/187 |
| 3,510,135 | 5/1970 | Gentile | 273/183 |
| 3,561,764 | 2/1971 | Thomas | 273/183 |
| 3,649,029 | 3/1972 | Worrell | 273/186 |
| 3,784,208 | 1/1974 | Weyganot | 273/183 |
| 3,860,247 | 1/1975 | Taylor | 273/186 |
| 3,899,179 | 8/1975 | Vlach | 273/183 |
| 3,999,765 | 12/1976 | Bishop | 273/183 |
| 4,101,130 | 7/1978 | Richards | 273/187 |
| 4,151,990 | 5/1979 | Josenhans | 273/2 |
| 4,164,352 | 8/1979 | O'Brien | 273/187 |

FOREIGN PATENT DOCUMENTS

| | | | |
|---|---|---|---|
| 17666 | 12/1915 | United Kingdom | 273/187 R |

*Primary Examiner*—George J. Marlo

*Attorney, Agent, or Firm*—Steele, Gould & Fried

[57] ABSTRACT

A portable and foldable two-piece alignment training device for golfers includes two sets of elongated strips, each set having three strips hingeably joined at their first ends. The two strip sets are joined together by an adjustable slide clip and placed on the ground to form an "I". The "I" pattern keys the golfer to align his swing thereto. Indicia indicate tee position, the golfer's body and foot position, flight direction of the ball, and retraction distance of the club from the tee.

6 Claims, 1 Drawing Sheet

ALIGNMENT TRAINING DEVICE FOR GOLFERS

BACKGROUND OF THE INVENTION

1. Field of the Invention

This invention relates to a training aid for golfers to assist golfers in improving the accuracy of their golf swing, and more particularly to a particular portable and collapsible aid device which adjustably indicates direction of intended golf ball flight path, foot and body positioning, club retraction distance and length of backswing, until the clubhead starts its upward arc.

2. Description of the Prior Art

There are many teaching aids to help a golfer learn the basic strokes or to improve his putting and his swing. Many devices include arrows or swing direction indicators and include a tee or an area on which the ball rests. A simple form of such a golf aid is disclosed in U.S. Pat. No. 1,484,064 to Erickson et al. This patent discloses a tee plate for golf courses which simply uses short arrows at the ends of the tee plate, the arrows pointing generally in the direction of the next green. There are no provisions for assisting in gauging backswing or player stance. Another golf tee which also indicates proper direction of the drive is disclosed in U.S. Pat. No. 1,761,532 to Morris. Morris shows a tee with two movable arrows to replace a sand tee, the arrows indicating the direction of swing and proper facing of the club for the drive. The arrows show the direction of flight but give neither indication of back stroke nor stance. Another device for indicating flight direction of a golf ball is placed on the tee itself. U.S. Pat. No. 3,899,179 to Vlach shows a disk-shaped swing guide which is placed over a tee and is rotated around the tee to indicate flight direction.

U.S. Pat. No. 3,166,327 to Champion discloses an arrow-shaped frame with adjustable indicators for foot and golf-ball_position. Using Champion's device, a golfer positions the frame on the ground with the ball inside the frame and points the frame in the direction of the flight of the ball. The user stands outside the frame, positioning his feet relative to indicia on the frame. The frame is not collapsible nor adjustable for the height of the golfer. Another frame-like structure used as a golfer's aid is disclosed in U.S. Pat. No. 3,561,764 to Thomas. A panel with cut-away areas defining intersecting paths is used as a guide for ball direction and "swing-out" of the club.

There are also many golf teaching devices which are basically mats on which a user positions himself and upon which various directional indicia reminders and guides have been placed. U.S. Pat. No. 4,101,130 to Richards shows a mat with cut-out portions delineating foot position, and indicia for correctly locating the golf ball in position, according to the length of club being used. U.S. Pat. No. 4,164,352 to O'Brien discloses a training mat for golfers with various foot placement areas on which the golfer stands, according to what kind of club is being used. U.S. Pat. No. 1,484,390 to Gibbs et al discloses a set of instruction charts illustrating foot position, hand grip and ball placement for each type of golf swing. A player stands on the chart to practice each swing. U.S. Pat. No. 3,784,208 to Weygandt discloses a triangular mat including indicia and a tee opening. A golfer positions himself at the base of the mat, with the triangle tip pointing in the direction of flight, and places his feet parallel to the ends of the mat. The mat folds for storage in the golf bag. Another golf practice mat is disclosed in U.S. Pat. No. 2,941,908 to Smith et al which includes a rectangular mat with arrow indicia and a tee on it. Adjustably extending from one mat side are a pair of rectangular secondary mats with upturned edges. Using this device, a player places his toes against the upturned edges of the secondary mats and hits a ball from the tee in the direction of the arrow.

Another type of golf aid is a golf putting aid which is disclosed in U.S. Pat. No. 3,860,247 to Taylor. Parallel strip members are joined by adjustable means. Scales and/or guides for ball calibration, putter positioning and foot positioning are provided.

There are also some training devices which include upright members for guiding the golfer in body position, swing and stance. Among these are U.S. Pat. Nos. 3,510,135, 3,649,029 and 3,999,765.

Insofar as the foregoing references teach useful functions for alignment devices having directional markings thereon, their disclosures are hereby incorporated. Only the invention, however, employs a set of conveniently collapsible and self-aligning strip sets that can accommodate persons of different heights, being collapsible into a set of stacked strips or deployed into a relatively large directional configuration.

SUMMARY OF THE DISCLOSURE

The device of this invention provides a portable and foldable multi-piece alignment and training device for golfers. Two sub-assembly pieces are each composed of three elongated strips, each including a movable connection at one strip end so that when the three strips are unfolded, each set can be opened out to form a "T". When the two sets are unfolded, they can be assembled by joining the central strips (legs) of the "T"'s with an adjustable transparent plastic sleeve, and laid on the ground. The device generally defines an "I" or "H" with hinge points defined at the junctions of vertical and transverse members. Alignable markings are included on the relatively movable parts in each set to ensure that the device when unfolded is precisely arranged with the upper and lower central strips exactly perpendicular to the body of the "I" (the adjoining strips) and parallel to each other. The transverse adjoining strips of the "I" are aligned parallel to a line from the ball to the flag, with the joined body member of the "I" (the two central strips) running perpendicular to that line. In addition to marks assisting in alignment, the device has a slidable part by which the distance between the golfer's feet and the ball can be set, and markers for alignment with the tee and for indicating a point to which the golfer will retract the clubhead (the "takeaway line") as a preliminary move to striking the ball.

It is, therefore, an object of this invention to provide an aiming device to aid the golfer in establishing proper stance and alignment to the desired direction of ball fight.

It is another object of this invention to provide a foldable and portable alignment training device which easily collapses to fit in a golf bag pocket, while retaining effective alignment capabilities when deployed.

It is still another object of this invention to provide an alignment device for golfers which is small when stored but defines a large visual guide when deployed and thus eliminates geometric error in determination of the line of flight.

It is yet another object of this invention to provide an alignment device for golfers which is adjustable for a golfer's height and which, by rotating the center bar 180°, also may be utilized by a left-handed golfer.

It is a further object of this invention to provide an alignment device for golfers which includes indicia to aid in proper distance of the club retraction from the tee prior to swinging.

It is a yet a further object of this invention to provide an alignment device for golfers which is inexpensive to produce and lightweight to carry.

These and other objects will be more readily ascertainable to one skilled in the art from a consideration of the following figures, description and exemplary embodiments, with the understanding that the drawings are illustrative only and that changes may be made in the specific construction illustrated and described within the scope of the appended claims.

BRIEF DESCRIPTION OF THE DRAWING(S)

DETAILED DESCRIPTION OF THE PREFERRED EMBODIMENT(S)

Figure 1:
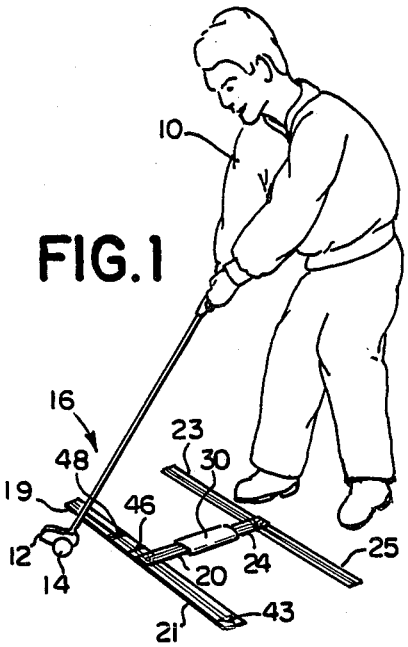
FIG. 1 is a perspective view of a golfer using the device of this invention.

Referring now to the drawings, and more particularly to FIG. 1, a golfer 10 is in the proper position relative to ball 14 with club 12 aligned properly, according to the markings on device 16. The structural particulars of device 16 are better explained with reference to FIGS. 2 and 3.

Figure 2:
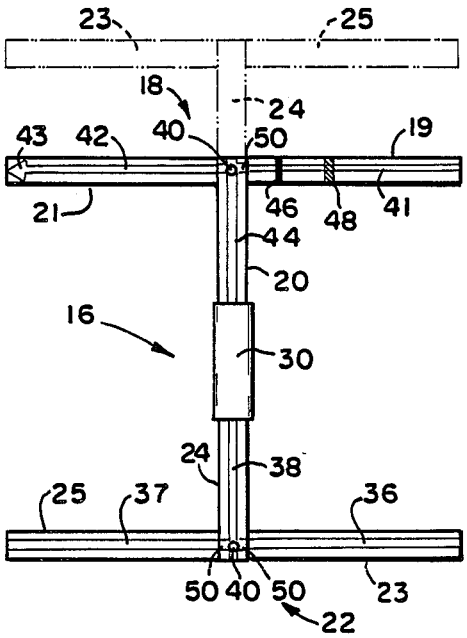
FIG. 2 is a top view of the device of this invention, the phantom lines indicating the alterative position for a left-handed golfer.
Figure 3:
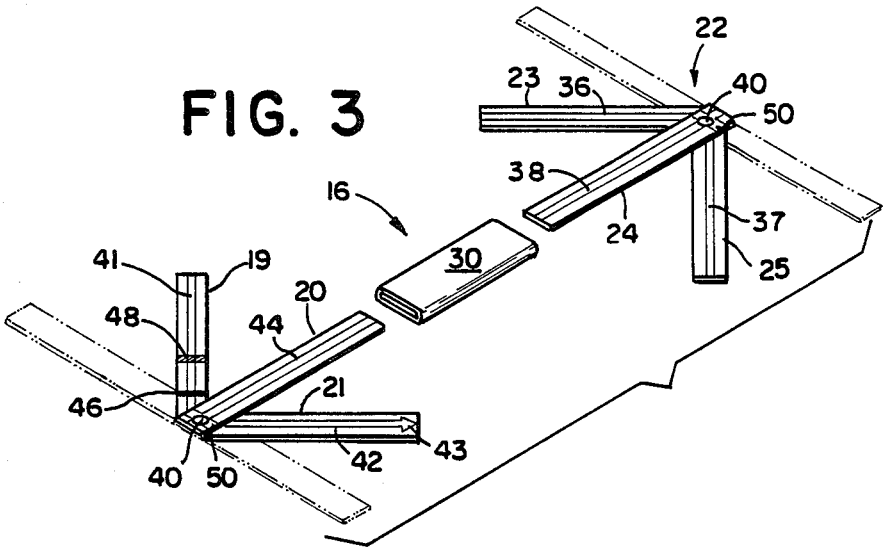
FIG. 3 is an exploded isometric view of the sections of the alignment device of this invention, the strip sets being shown partially folded.

Referring now to FIGS. 2 and 3, device 16 is seen fully expanded and in proper alignment for use in FIG. 2, and in FIG. 3 device 16 is seen disassembled and partially folded in an exploded view. Device 16 has three components two sets of three pivotably connected strips, 18 and 22, and a transparent plastic sleeve 30 receiving one of the strips from each set. Strip sets 19 and 22 are preferably composed of polycarbonate plastic strips of equal length, each strip set held together by a connector 40 at one end of the strips. Each strip is preferably twenty inches long by one and seven eighth inches wide by one eighth inch thick. The connector is preferably a rivet, grommet, bolt or the like which fixes the strips but allows the pieces 19, 20 and 21 and 23, 24 and 25 to be rotated relative to each other. Connector 40 can be formed integrally with the strips, for example as a push pin on a lowermost stip engaging rotatably with a hole on the next successive strips. The sets 18 and 22 are joined by transparent plastic sleeve 30 which is preferably plastic and allows the strips 24 and 20 to be joined at varying distances from each other, an adjustment which permits extending the distance from the golfer to the ball, according to the golfer's height.

Each strip includes indicia. Strips 25 and 23 include elongated marker lines 37 and 36, respectively. Strip 21 includes elongated marker line 42 with arrow 43 at its end. Strip 19 includes elongated marker line 41, transverse tee line 46 and transverse club retraction line 48. Strips 20 and 24 include elongated marker lines 44 and 38 respectively. At one end of strips 20 and 24, cross strip 50 reaches across the strip width. The markings serve to align the strips when deployed and to align the golfer and the golfer'swing to the ball and to the desired flight path. All these marking will be explained more fully with reference to the actual use of device 16 as an aid to the golfer.

As is seen in FIG. 3, strip sets 18 and 22 each can be folded by rotating the strips on their connectors 40. When folded, the strip sets and slide connector 30 are easily stowed in a golf bag pocket, being only the size of a stack of strips, when folded.

Now with reference to FIGS. 1, 2 and 3, the use of device 16 is explained. Golfer 10 assembles device 16 by placing the free ends of strips 20 and 24 into opposing ends of transparent plastic sleeve 30. The depth of insertion of strips 20 and 24 will vary as a function of the golfer's height and the length of the club he is using. The assembled device 16 is placed on the ground forming a precisely squared-off letter "I" with arrow 43 pointing at the target (usually the flag on the green). A precisely-square "I" is formed by aligning lines 37, 50 and 36 on each of the relatively movable strips in a perfectly straight line, and aligning lines 42, 50 and 41 likewise. The lines are printed or molded into the strips at the required orientations for correct alignment when deployed. When the respective segments of the lines are straight, then strips 20 and 24 form perfect right angles with their connected other strips 21 and 19 and 23 and 25, respectively. The importance of the perfect alignment is found in the fact that if the line of flight is off by even one degree, the ball may be off target by many feet at the end of its trajectory of many yards.

The golfer places his feet a few inches behind the bottom of the "I" (behind strips 25 and 23) and stands with his feet a comfortable distance apart. The ball 14 or a tee for holding ball 14 is placed a few inches in front of tee marker 46. Golfer 10 assumes a position preparatory to swinging, whereupon the "I" pattern of the device keys the golfer to align his body and swing with the required line of flight. The golfer draws club 12 slowly back, keeping the club head low to the ground until it reaches the club retraction line 48, at which point he turns his shoulders and lifts his club to start his swing. The golfer, using this device as a reference grid will very soon learn to correctly drive his shots, because he has learned proper ball placement and body placement to ensure a straight shot, rather than a hook or a slice.

Device 16 works equally well with both right-handed golfers and left-handed golfers. Referring to FIG. 2, a left-handed golfer uses device 16 by positioning the device as indicated by the lines in phantom.

An advantage of device 16 over many devices, including shorter aiming aids, is the fact that the invention assures that the golfer's feet are parallel to the desired line of flight of the ball. There is a standard golf practice teaching method including placing three golf clubs on the ground in a right angle formation. This technique, however, is relatively inaccurate because no means are provided to align the clubs the same each time or precisely at right angles to each other. The parallel clubs may not indeed be parallel and/or the configuration may be otherwise misaligned. Device 16 takes the guess work out of the placement of the indicators because it has self-aligning means, namely lines 50, which ensure that strips 24 and 20 are at perfect right angles to the parallel strip members 21 and 19 and 25 and 23. Notwithstanding the collapsible nature of the device, means are included to ensure correct alignment.

It is preferred that the strips be white polycarbonate and the elongated lines be one bright color, e.g., bright green. The transverse lines are a contrasting color, but any lightweight plastic marked with bright colors is suitable. The lines can be printed or painted on the strips, molded therein, or laid down as adhesive strips.

The set connector is shown as a transparent plastic sleeve, but any elongated connector which provides for adjustment is suitable and within the scope of this invention.

There are many advantages to the alignment device of this invention. Chiefly, it provides an accurate, foldable and portable device which aids the golfer in perfecting his aim.

Having now illustrated and described the invention, it is not intended that such description limit this invention, but rather that this invention be limited only by reasonable interpretation of the appended claims.

What is claimed is:

1. An alignment, device for golfers comprising:

two sets of three elongated strips, each said set including one central strip and two adjoining strips, each of said three strips having first and second ends;

two connectors, respective ones of which rotatably join the second ends of said three strips of each strip set;

set connecting means operable to adjustably attach together the central strips of each set; and indicia on selective ones of said strips so that when the central strip of one set is joined to the central strip of the other set at their first ends and said adjoining strips of each set are rotated on said connectors to be perpendicular to said central strips, said device becomes I-shaped and when placed on the ground indicates a desired flight path of the golf ball, degree of club retraction and proper tee placement.

2. The alignment device for golfers according to claim 1 wherein said set connecting means comprises a plastic sleeve having a width predetermined to simultaneously span the central strips of said two sets, whereby the distance between the legs of said "I" may be varied by sliding the central strips therein.

3. The alignment device for golfers according to claim 1 wherein said indicia on one said adjoining strip further comprise a directional arrow.

4. The alignment device for golfers according to claim 3 wherein said indicia further comprise a tee placement marking on said strip adjoining said strip including the directional arrow.

5. The alignment device for golfers according to claim 4 wherein said indicia further comprise a mark to indicate distance of retraction of club from the tee marking.

6. The alignment device for golfers according to claim 1 wherein said indicia on said strips further comprise intersecting lines to determine perpendicular arrangement of the strips.

* * * * *